US007686571B1

(12) United States Patent
Matheny

(10) Patent No.: US 7,686,571 B1
(45) Date of Patent: Mar. 30, 2010

(54) BLADED ROTOR WITH SHEAR PIN ATTACHMENT

(75) Inventor: Alfred P. Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 548 days.

(21) Appl. No.: 11/784,782

(22) Filed: Apr. 9, 2007

(51) Int. Cl.
*F01B 25/16* (2006.01)

(52) U.S. Cl. ..... 415/9; 415/200; 415/209.4; 415/210.1; 415/211.2; 415/213.1

(58) Field of Classification Search ..... 415/9, 415/200, 209.3, 209.4, 210.1, 211.2, 213.1, 415/215.1
See application file for complete search history.

(56) References Cited

U.S. PATENT DOCUMENTS

| | | | | |
|---|---|---|---|---|
| 1,050,187 | A | 1/1913 | Westinghouse | |
| 1,347,031 | A | 7/1920 | Guy | |
| 1,415,266 | A | 5/1922 | Rice | |
| 2,430,185 | A | 11/1947 | Pescott | |
| 2,445,154 | A * | 7/1948 | Reed | 416/221 |
| 2,651,494 | A | 9/1953 | Persson | |
| 2,658,718 | A | 11/1953 | Walker | |
| 2,974,924 | A | 3/1961 | Rankin et al | |
| 4,767,275 | A | 8/1988 | Brown | |
| 4,820,124 | A * | 4/1989 | Fried | 416/191 |
| 5,073,084 | A | 12/1991 | Hirst | |
| 5,129,786 | A | 7/1992 | Gustafson | |
| 5,368,444 | A | 11/1994 | Anderson | |
| 5,372,481 | A | 12/1994 | Boyd | |
| 5,380,157 | A | 1/1995 | Shaffer | |
| 5,435,693 | A | 7/1995 | Shaffer | |
| 5,601,407 | A | 2/1997 | Humhauser | |
| 5,860,787 | A | 1/1999 | Richards | |
| 6,499,959 | B1 | 12/2002 | Reluzco et al. | |
| 6,761,537 | B1 | 7/2004 | Shapiro et al. | |

* cited by examiner

*Primary Examiner*—Igor Kershteyn
(74) *Attorney, Agent, or Firm*—John Ryznic

(57) ABSTRACT

A stator vane assembly for a gas turbine engine, the stator vane including an airfoil portion formed from a single crystal material and two platforms attached to the ends of the airfoil by shear pins that fit within slots formed between the platform and airfoil. The shear pin slots extend along the contour of the airfoil where the lowest stress levels are located. The platforms include openings having the same cross sectional shape as the curved airfoil. Because of the shear pin retainers between the airfoil and the platforms, the airfoil can be formed from a single crystal material while the platforms are un-coupled from the airfoil and can be made from a different material.

8 Claims, 3 Drawing Sheets

BLADED ROTOR WITH SHEAR PIN ATTACHMENT

CROSS-REFERENCE TO RELATED APPLICATIONS

This application is related to U.S. Regular patent application Ser. No. 11/605,857 filed on Nov. 28, 2006 by Alfred P. Matheny and entitled TURBINE BLADE WITH ATTACHMENT SHEAR PINS; and to U.S. Regular patent application Ser. No. 11/708,215 filed on Feb. 20, 2007 by Alfred P. Matheny and entitled BLADED ROTOR WITH SHEAR PIN ATTACHMENT.

BACKGROUND OF THE INVENTION

1. Field of the Invention

The present invention relates generally to fluid reaction surfaces, and more specifically to attaching a turbine stator vane with blade to platform attachment structure.

2. Description of the Related Art Including Information Disclosed Under 37 CFR 1.97 and 1.98

A gas turbine engine includes a turbine section with four stages of stator vanes and rotor blades that convert the energy from the hot gas flow into mechanical energy that drives the rotor shaft. The engine efficiency can be increased by passing a higher temperature flow into the turbine. The highest temperature safely capable of use is limited to the material characteristics of the turbine components, especially the first stage vanes and blades since these airfoils are exposed to the directly discharged from the combustor.

An airfoil made from a single crystal material can be operated under a higher temperature than a nickel based superalloy. However, a single crystal material vane is difficult to cast because the platforms for the vane are also cast with the airfoil as a single piece. A lower successful cast rate is accomplished with single crystal vanes, which significantly increases the overall cost for a stator vane. Nickel super-alloy vanes are cast as a single piece with the outer shroud or platform used to support the vane in the engine. The inner shroud or platform of the vane is located on the opposite end of the vane and produces a seal between the rotor blade and shaft. Thus, the load placed on the stator vane by the passing hot gas flow is supported totally by the outer shroud or platform of the stator vane. Therefore, the outer shroud of the stator vane must be massive and rigid enough to support the vane during engine operations.

Therefore, there is a need in the art for a stator vane that includes an airfoil portion made from a single crystal material, and for an un-coupled platform that can be made from a different material but secured to the airfoil portion so that the outer shroud or platform can adequately support the loading on the vane.

One prior art blade attachment method is shown in U.S. Pat. No. 5,129,786 issued to Gustafson on Jul. 14, 1992 and entitled VARIABLE PITCH FAN BLADE RETENTION ARRANGEMENT which discloses a fan blade attached to a disc arm by circular shaped pins secured within first and second seating grooves formed in the blade root and the disc arm opening. One problem with the Gustafson invention is that the circular retaining pins cannot withstand very high shear stress that would result in a turbomachine such as a compressor that operates at high rotational speeds. Another problem with the Gustafson invention is that the resulting force of the fluid acting on the surface of the blade will cause the blade root portion to bend within the supporting opening in the disc arm. In the Gustafson invention, because the retaining pins do not follow the outline of the airfoil surface, the airfoil bending load does not transfer directly to the shear pin.

Another prior art blade retaining method is shown in U.S. Pat. No. 2,974,924 issued to Rankin on Mar. 14, 1961 and entitled TURBINE BUCKET RETAINING MEANS AND SEALING ASSEMBLY which discloses a turbine blade (bucket) attached to the rotor disk by pins fitted within slots on the sides of the blade and the opening of the rotor disk. Four pins for each blade are used, with two pins on each side of the blade root, and where the two pins on the side are angled or offset along a straight line from each other. This offset arrangement of the retaining pins will support the shear loads from the bending force acting on the airfoil surface more than in the above cited Gustafson invention, but still not like the present invention. also, Rankin discloses the retaining pins to be circular or round in cross sectional shape, but also discloses that the pins can have a square cross section (see column 2, line 60).

It is an object of the present invention to provide for a stator vane with an airfoil made from a single crystal material.

It is another object of the present invention to provide for a stator vane with the shrouds un-coupled from the airfoil portions, but capable of supporting the stator vane under engine operations.

It is another object of the present invention to provide for a stator vane in which the airfoil portion can be easily replaced in the stator vane assembly (the airfoil and the platforms).

BRIEF SUMMARY OF THE INVENTION

The stator vane for use in a gas turbine engine of the present invention includes an airfoil that is secured to the inner and the outer shroud or platforms by a shear pin retainer that is secured within a groove formed between the airfoil and the platform, in which the groove follows the contour of the airfoil wall where the stresses from the loads applied to the stator vane are the minimum. Also, by un-coupling the platforms from the airfoil, the airfoil can be formed from a single crystal material while the platforms can be made from any other material (or the same material) that will provide for high strength to support the stator vane and provide for temperature resistance for resistance to heat and improved creep resistance. Each platform is secured to the airfoil by the curved shear pin retainers so that each platform can be made separately from the single crystal airfoil. Also, the shear pin retainer in the outer platform has a larger diameter than the retainer in the inner platform because of the higher loads operating on the outer platform.

DETAILED DESCRIPTION OF THE INVENTION

Figure 1:
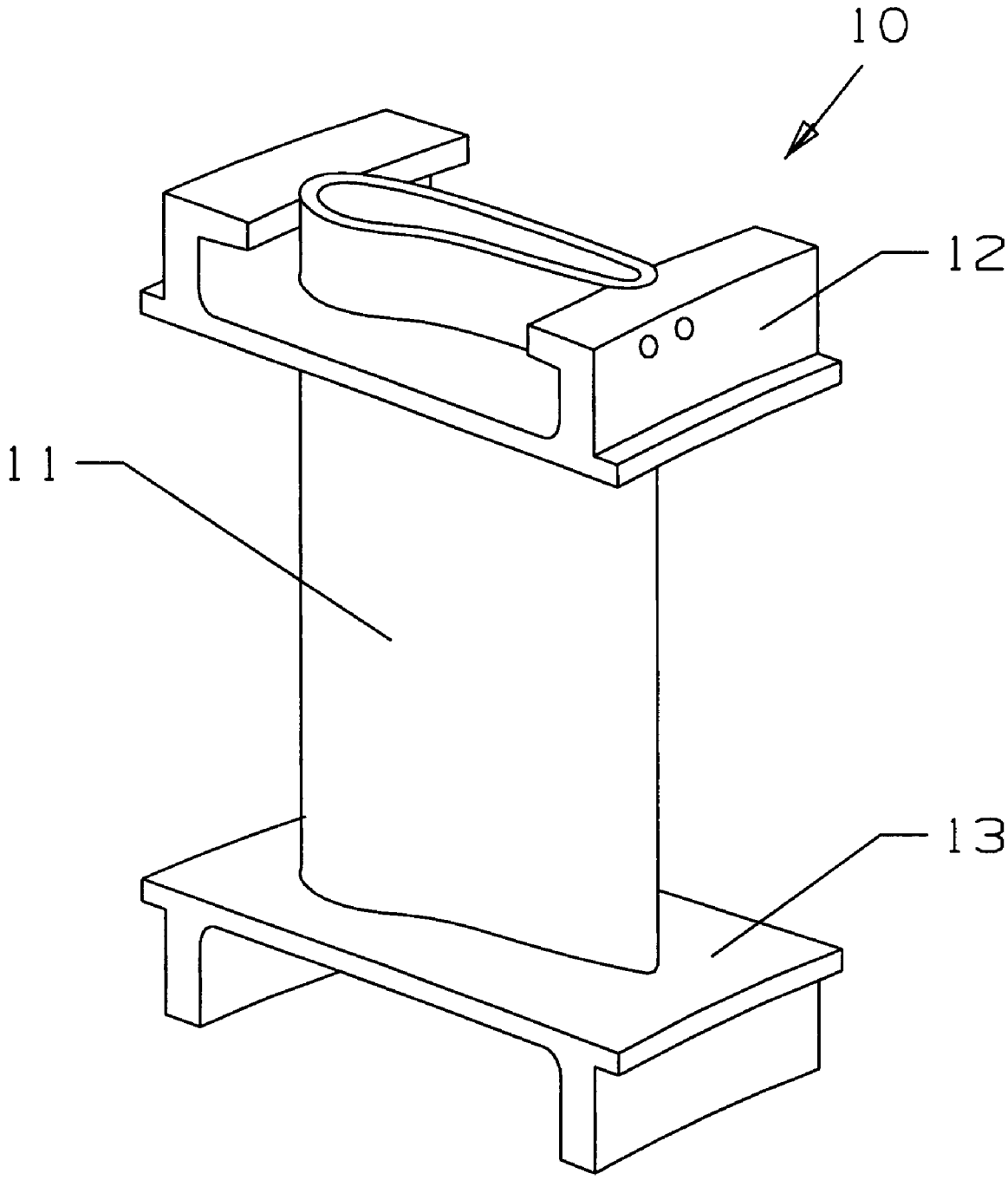
FIG. 1 shows a schematic view of a stator vane of the present invention used in a gas turbine engine.

A stator vane of the present invention is shown in FIG. 1 in which the stator vane 10 includes an airfoil having the leading and trailing edges and the pressure and suction sides of the prior art vanes. On the outer side of the airfoil 11 (top side in FIG. 3) is an outer platform attachment portion, and on the inner side of the airfoil is an inner platform attachment portion. An outer shroud or platform 12 is secured to the airfoil 11 outer attachment portion and includes hooks or some other well known attachment structure in which the stator vane is supported within the casing of the engine. On the other end of the airfoil 11 is the inner shroud or platform 13 which is secured to the lower end of the airfoil attachment portion. The inner platform 13 includes part of a labyrinth or some other well known prior art sealing members to provide a seal between the stationary platform of the stator vane and the rotor blade and rotor shaft of the engine. The outer platform 12 and the inner platform 13 have platform surfaces facing each other that form the flow path between the airfoil of the vane. These surfaces are exposed to the hot gas flow through the stator vane and are usually coated with a thermal barrier coating (TBC) to provide additional thermal protection to the vane.

Figure 2:
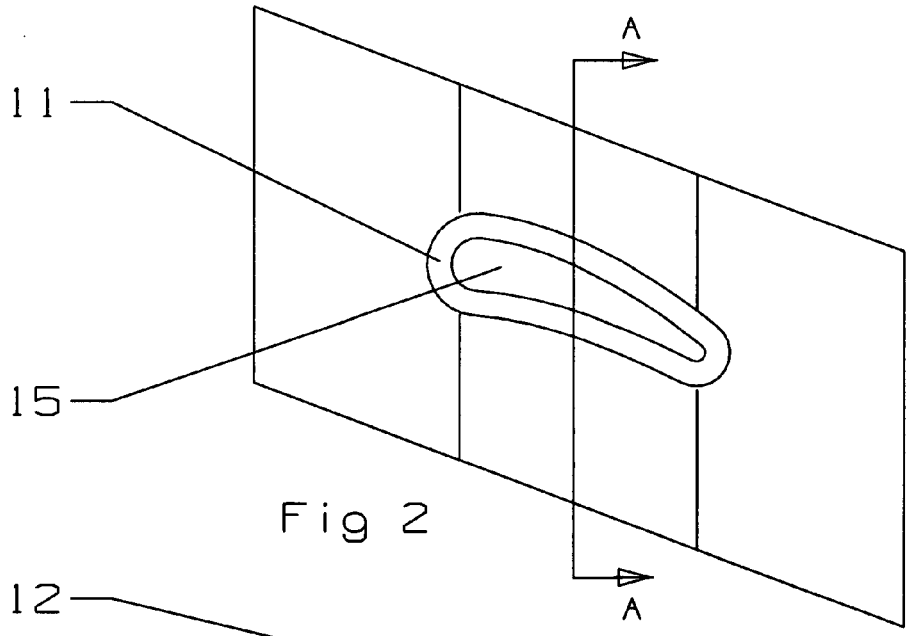
FIG. 2 shows a cross section of a top view of the stator vane of the present invention.

FIG. 2 shows a top view of the stator vane of FIG. 1 and include an inner cooling air passage 15 to provide cooling air for the vane and the platforms. The airfoil of the vane can have any of the well known cooling air passage arrangements to provide cooling for the stator vane without departing from the spirit or scope of the present invention. Both the airfoil and the two platforms can include film cooling holes and cooling passages to provide both impingement cooling and film cooling to the vane.

Figure 3:
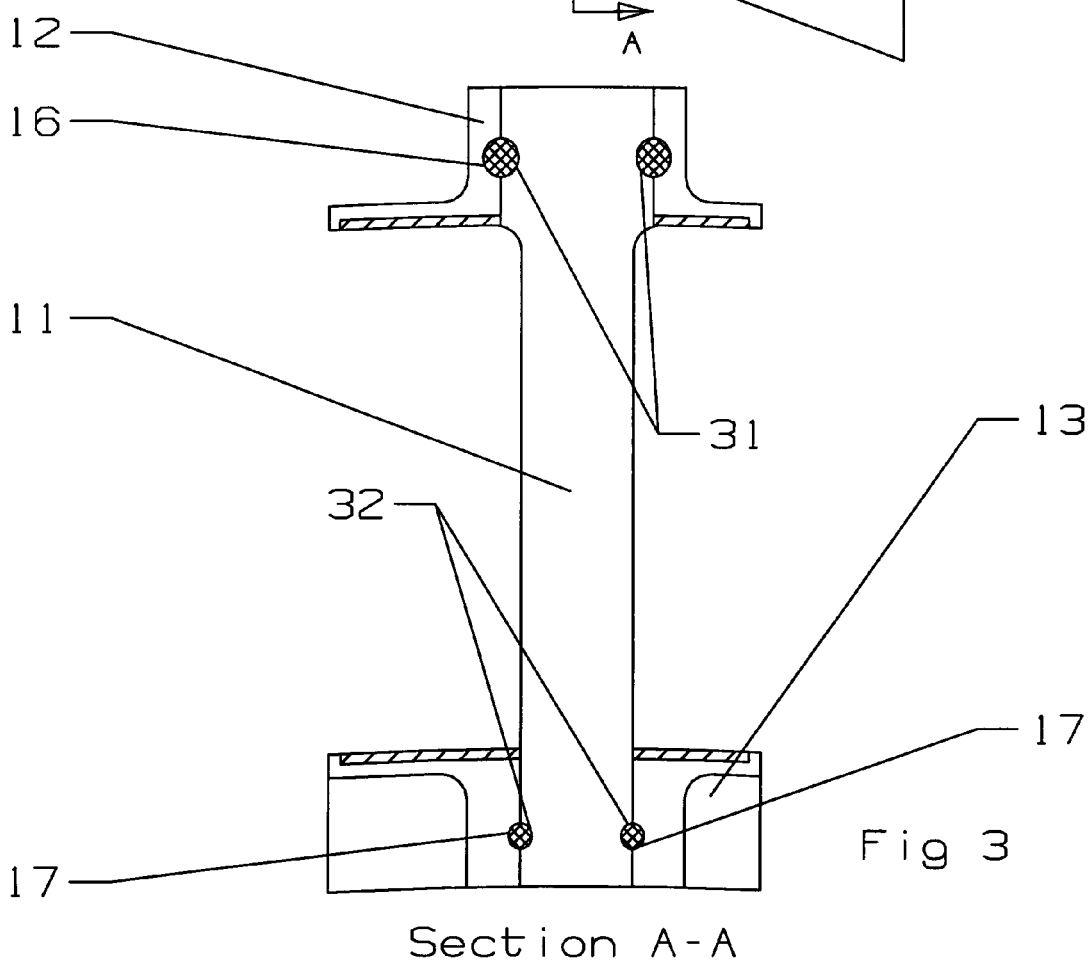
FIG. 3 shows a cross section of a side view of the stator vane of the present invention.

FIG. 3 shows a cross section of a side view of the stator vane of FIG. 1. The airfoil 11 extends between the outer shroud or platform 12 and the inner shroud or platform 13. The shear pin retainers 31 are shown located within grooves that are formed between the platform and the part of the airfoil opposed to the platform. Grooves 16 are formed on the outer shroud 12 on the pressure side and the suction side of the airfoil on both the platform and the airfoil. The opposed grooves 16 form a slot for the shear pin retainer 31 to be placed that functions to retain the airfoil to the outer platform 12. Another set of grooves 17 are located on the inner platform 13 and the airfoil 11 on the pressure side and the suction side of the airfoil on both the platform and the airfoil. A second shear pin retainer 32 is placed within the lower slot to retain the inner platform 13 to the airfoil 11. The outer shear pin 31 is larger in diameter than the inner shear pin 32 because the loads applied to the outer shear pin 31 is greater. The outer shear pin 31 secures the airfoil and the inner platform to the outer platform, while the inner shear pin 32 only secures the inner platform to the airfoil 11.

The shear pins 31 and 32 and the slots formed from adjacent grooves can have a round cross sectional shape as shown in FIG. 3, or can have a rectangular cross sectional shape depending upon the strength of the design.

Figure 4:
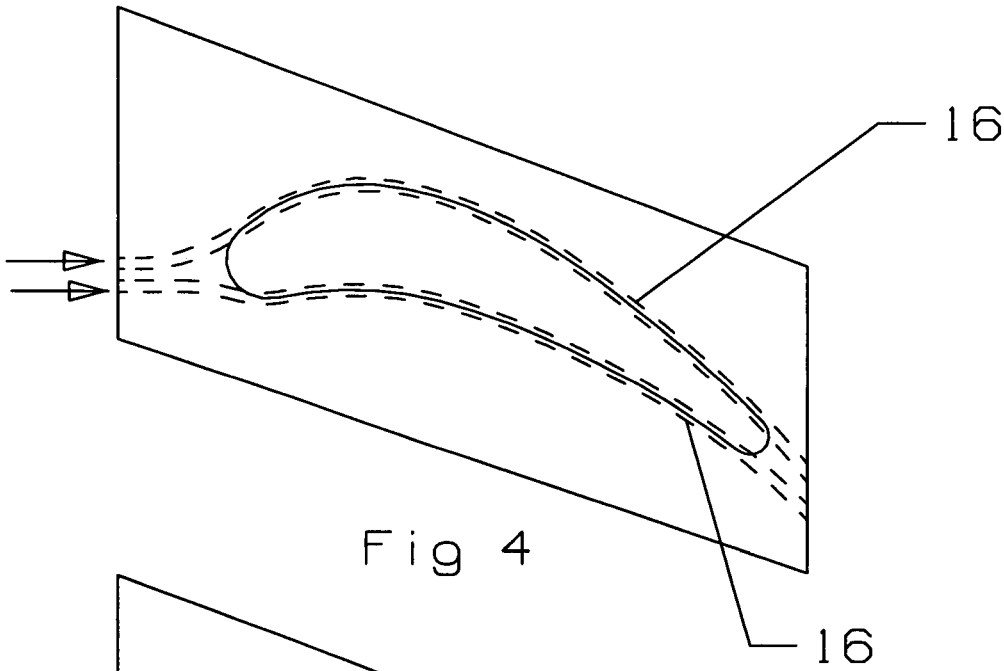
FIG. 4 shows a cross section view of a first embodiment of the shear pin retainers and grooves of the present invention.
Figure 5:
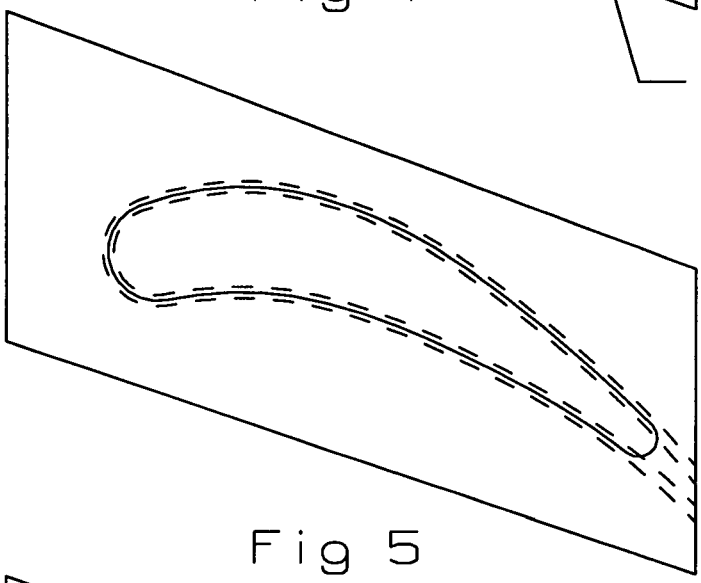
FIG. 5 shows a cross section view of a second embodiment of the shear pin retainers and grooves of the present invention.
Figure 6:
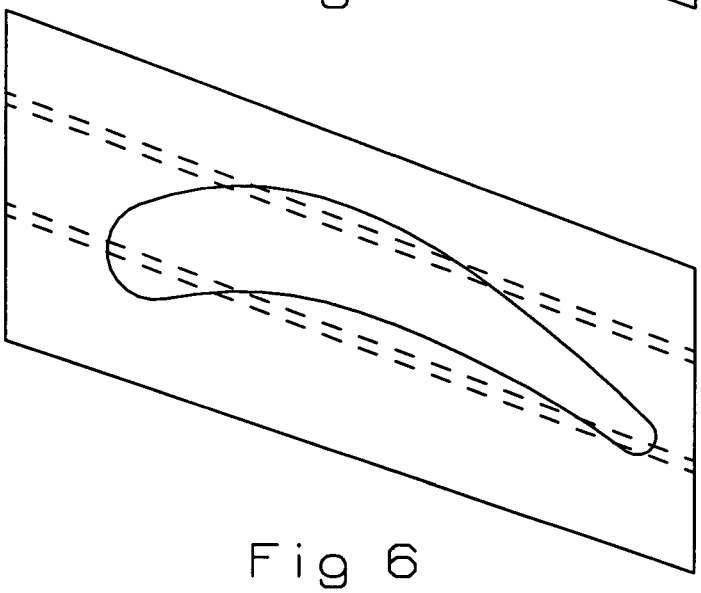
FIG. 6 shows a cross section view of a third embodiment of the shear pin retainers and grooves of the present invention.

FIGS. 4 through 6 shows several embodiments of the shear pin retainers and the grooves that are used to hold the shear pins. FIG. 4 shows an embodiment in which the suction side grooves 16 and the pressure side grooves 16 from slots that follow the contour of the airfoil wall such that about half of the shear pin is located beneath the airfoil wall. In the FIG. 4 embodiment, the slots 16 extend from the leading edge side to the trailing edge side of the platform. A semi-flexible shear pin is inserted into the slot from one end and pushed into place. The shear pin can be removed by pushing the pin out from the slot in either direction.

The FIG. 5 embodiment shows the grooves starting on the trailing edge end of the platform, passing around the suction side, then the leading edge, and then the pressure side before opening out on the same side the slot began. In this embodiment, a liquid or molten metallic material that is used to form the hardened shear pin is poured into one of the openings until enough material is within the slot to form the shear pin. Or, a shear pin that has been heated to form a plastic shear pin is inserted and allowed to cool to a hardened shear pin can be used in either of the embodiments of FIGS. 4 through 6. To remove the hardened shear pin from the slot, a heat source can be placed along the platform and following the slot as close as possible to apply direct heat to the shear pin and cause the shear pin to become plastic enough for removal.

In FIG. 6, the embodiment uses substantially straight slots positioned along the pressure side and the suction side of the airfoil and aligned such that the maximum amount of coverage along the airfoil wall contour can be made. This straight type slot is used when a shear pin of low flexibility must be used to retain the platforms to the airfoil. The grooves that form the slot extend from the leading edge side of the platform to the trailing edge side of the platform as in the FIG. 4 embodiment, but do not curve along the airfoil wall contour.

Since the airfoil without the platforms is formed of a generally straight piece from top to bottom as seen in FIG. 3, more successful castings of a single crystal material can be accomplished, resulting in a lower cost of manufacture for the stator vanes. The single crystal material and the casting process are very expensive. Also, a stator vane can be made in which the single crystal material airfoil can be supported within the inner and outer platforms that are made from a different material. The platforms can be made from a material that has different mechanical properties than that of the airfoil in order to reduce the weight of the stator vane and maximize the life cycle fatigue, thermal mechanical fatigue, creep resistance, and therefore improve the overall life of the stator vane.

The invention claimed is:

1. A turbine stator vane for use in a gas turbine engine, the stator vane comprising:

an airfoil having a pressure side and a suction side with a curvature toward the pressure side, the airfoil having a platform attachment portion on one end for attachment to a platform;

the platform having an opening sized to fit the airfoil attachment portion;

a platform retainer groove in the platform extending along the pressure and the suction sides of the airfoil;

an airfoil retainer groove in the airfoil platform attachment portion extending along the pressure side and the suction side of the airfoil;

the retainer grooves extending along a contour of the airfoil and forming a retainer slot; and, a shear pin secured within the retainer slots on the pressure side and the suction side of the airfoil to secure the airfoil to the platform.

2. The stator vane of claim 1, and further comprising:

the retainer slots on the pressure side and the suction side of the airfoil opens on the leading edge side or the trailing edge side of the platform for insertion of the shear pin.

3. The stator vane of claim 2, and further comprising:

the retainer slots on the pressure side and the suction side of the airfoil opens on both the leading edge side and the trailing edge side of the platform for insertion or removal of the shear pin from either side of the platform.

4. The stator vane of claim 1, and further comprising:

the retainer slots on the pressure side and the suction side of the airfoil opens on the leading edge side or the trailing edge side of the platform for insertion of the shear pin and curves around the airfoil to form a continuous retainer slot.

5. The stator vane of claim 1, and further comprising:

the airfoil is formed from a single crystal material.

6. The stator vane of claim 5, and further comprising:

the platform is formed from a non-single crystal material.

7. A turbine stator vane for use in a gas turbine engine, the stator vane comprising:

an airfoil having a pressure side and a suction side with a curvature toward the pressure side, the airfoil having an platform attachment portion on one end for attachment to a platform;

the platform having an opening sized to fit the airfoil attachment portion;

a platform retainer groove in the platform extending along the pressure and the suction sides of the airfoil;

an airfoil retainer groove in the airfoil platform attachment portion extending along the pressure side and the suction side of the airfoil;

the retainer grooves extending along a contour of the airfoil and forming a retainer slot;

a shear pin secured within the retainer slots on the pressure side and the suction side of the airfoil to secure the airfoil to the platform;

the airfoil having an inner and outer platform attachment portions for attachment to inner and outer platforms;

an inner platform having an opening sized to fit the airfoil inner attachment portion;

an inner platform retainer groove in the inner platform extending along the pressure side and the suction side of the airfoil;

an airfoil retainer groove in the airfoil inner platform attachment portion extending along the pressure side and the suction side of the airfoil;

the retainer grooves extending along the contour of the airfoil and forming an inner platform retainer slot; and, a plurality of shear pins secured within the retainer slots on the pressure side and the suction side of the airfoil to secure the airfoil to the inner and outer platforms.

8. The stator vane of claim 7, and further comprising:

the outer retainer slot is larger in diameter than the inner retainer slot.

* * * * *